US006231382B1

(12) United States Patent
Yu

(10) Patent No.: US 6,231,382 B1
(45) Date of Patent: May 15, 2001

(54) ELECTRICAL CARD CONNECTOR HAVING STAND OFF

(75) Inventor: Hung-Chi Yu, Hsi-Chih (TW)

(73) Assignee: Hon Hai Precision Ind. Oc., Ltd., Taipei Hsien (TW)

( * ) Notice: Subject to any disclaimer, the term of this patent is extended or adjusted under 35 U.S.C. 154(b) by 0 days.

(21) Appl. No.: 09/360,071

(22) Filed: Jul. 23, 1999

(30) Foreign Application Priority Data

Feb. 2, 1999 (TW) ..... 88201715

(51) Int. Cl.[7] ..... H01R 13/73
(52) U.S. Cl. ..... 439/541.5; 439/159; 439/64
(58) Field of Search ..... 439/541.5, 64, 439/377, 159

(56) References Cited

U.S. PATENT DOCUMENTS 5,490,791 * 2/1996 Yamada et al. ..... 439/159
5,812,660 * 9/1998 Suzuki et al. ..... 379/439
6,019,633 * 2/2000 Tung et al. ..... 439/570
6,045,366 * 4/2000 Motomu ..... 439/64
6,048,214 * 4/2000 Hirata ..... 439/101
6,059,586 * 5/2000 Watanabe et al. ..... 439/159

* cited by examiner

*Primary Examiner*—Brian Sircus
*Assistant Examiner*—Son V. Nguyen
(74) *Attorney, Agent, or Firm*—Wei Te Chung

(57) ABSTRACT

An electrical card connector comprises a main body, a top shield covering a top portion of the main body, a bottom shield covering a bottom portion of the main body and a stand-off attached to the top shield. The top shield forms two latches on a side wall thereof. The stand-off includes a base and a terminal portion extending from one edge of the base for being mounted on a circuit board. The base defines two rectangular holes for extension and engagement with the latches of the top shield, and a spring tab for pressing against the top shield. The terminal portion defines a screw hole for threadedly mounting on the circuit board by a bolt.

2 Claims, 7 Drawing Sheets

ELECTRICAL CARD CONNECTOR HAVING STAND OFF

BACKGROUND OF THE INVENTION

1. Field of the Invention

The present invention relates to an electrical card connector, and particularly to an electrical card connector having a stand-off arrangement.

2. Description of the Prior Art

Some electrical card connectors have stand-offs mounted on a printed circuit board for providing clearance between the connector and the printed circuit board thereby allowing components such as semiconductors to be mounted on the printed circuit board below the card connector. Generally, the stand-offs are placed in pairs on both sides of the electrical card connector. However, providing a stand-off having a simple structure for facilitating manufacture and assembly has been a longstanding issue confronting designers in this field. The present invention provides an improved stand-off for an electrical card connector.

SUMMARY OF THE INVENTION

Accordingly, an object of the present invention is to provide an electrical card connector including a stand-off having a structure which facilitates manufacture and assembly.

In a preferred embodiment of the present invention, an electrical card connector comprises a top shield and a stand-off attached to the top shield. The top shield has at least one latch. The stand-off includes a base and a terminal portion extending from one edge of the base for mounting on a circuit board. The base defines at least one rectangular hole for extension of and engagement with the at least one latch of the top shield, and at least one spring tab for pressing against the top shield.

BRIEF DESCRIPTION OF THE DRAWINGS

Other objects and advantages of the present invention will be understood from the following description of an electrical card connector according to preferred embodiments of the present invention shown in the accompanying drawings, in which.

DETAILED DESCRIPTION OF THE PREFERRED EMBODIMENTS

Figure 1:
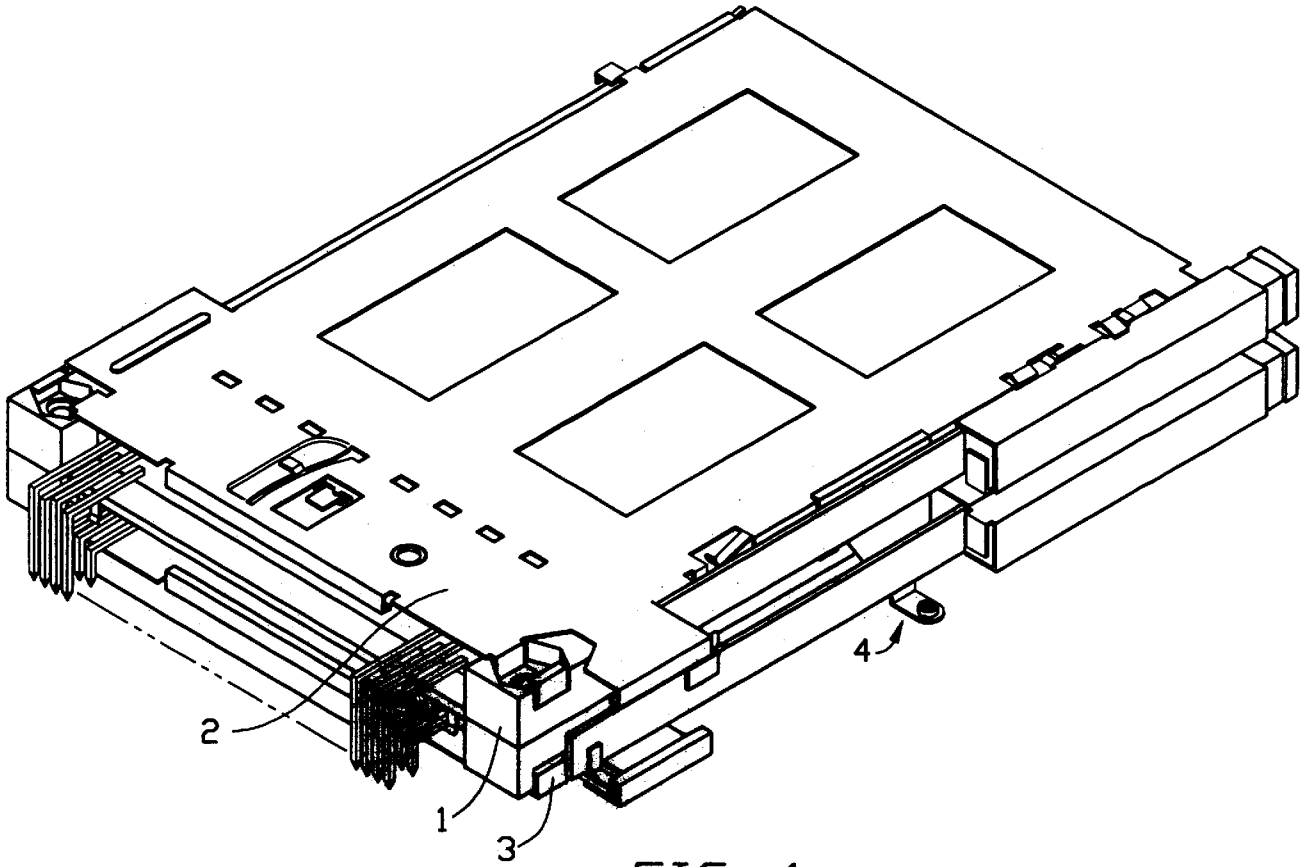
FIG. 1 is a perspective view of an electrical card connector embodying a concept of the present invention.

For facilitating understanding, like components are designated by like reference numerals throughout the various embodiments shown in the attached drawing figures.

FIG. 1 shows an electrical card connector of the present invention comprising a main body 1, a top shield 2 covering a top portion of the main body 1, a bottom shield 3 covering a bottom portion of the main body 1 and a stand-off 4 attached to the top shield 2.

Figure 2:
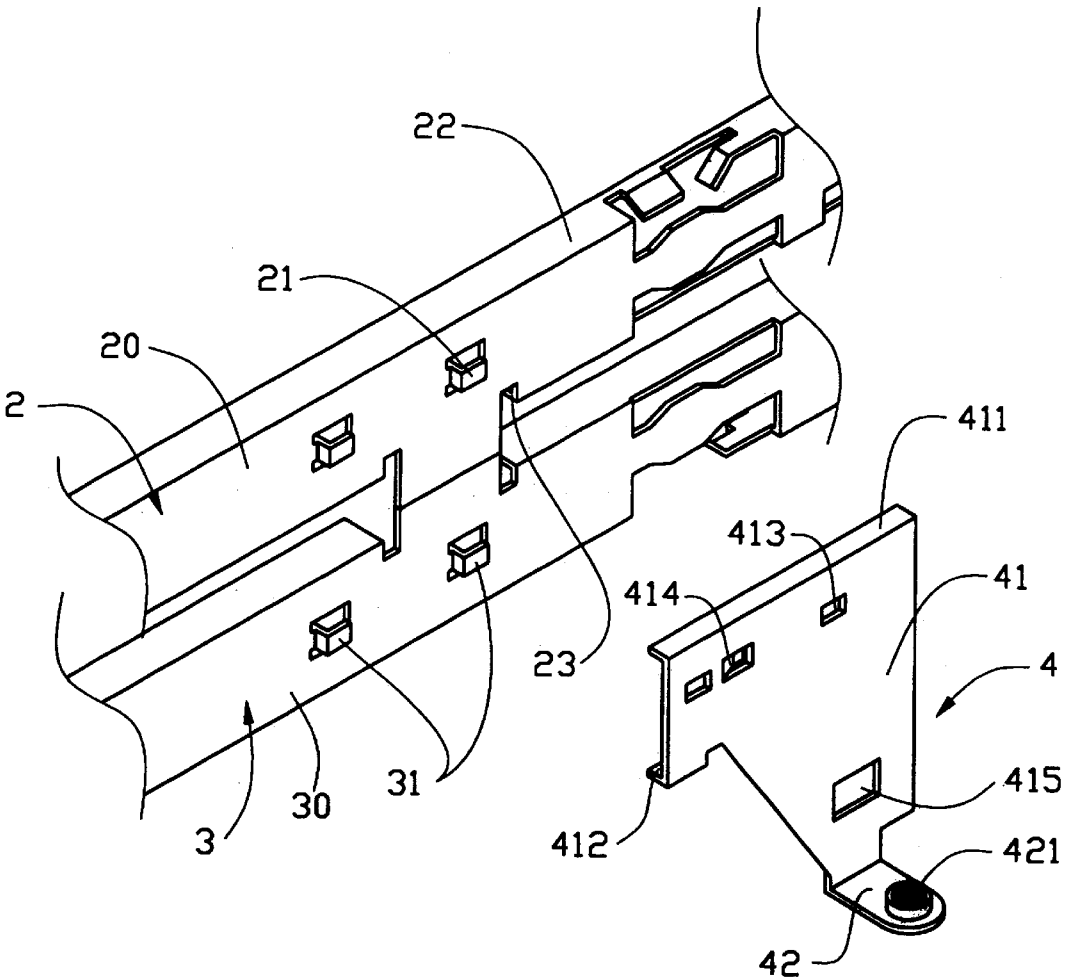
FIG. 2 is a partially exploded view of FIG. 1.

Referring to FIG. 2, the top and bottom shields 2, 3 each form two latches 21, 31 on side walls 20, 30 thereof. The top shield 2 forms a flange 22 and a shoulder 23 on opposite longitudinal edges of the side wall 20.

The stand-off 4 includes a base 41 and a terminal portion 42 extending perpendicularly from one edge of the base 41. The base 41 forms a lip 411 perpendicularly extending from an edge thereof opposite the terminal portion 42 for abutting against the flange 22 of the top shield 2. A tab 412 is stamped from the base 41 opposite the lip 411 for abutting against the shoulder 23 of the top shield 2. Two rectangular holes 413 are formed in the base 41 proximate the lip 411 and corresponding to the latches 21 of the top shield 2. A spring tab 414 is stamped from the base 41 adjacent to one rectangular hole 413 proximate the tab 412 for pressing against the side wall 20 of the top shield 2. The base 41 forms an opening 415 distanced from the lip 411 for receiving one of the latches 31 of the bottom shield 3 without any contact occurring therebetween. The terminal portion 42 defines a screw hole 421 in a free end thereof for extension of a bolt (not shown) therethrough to fix the connector on a printed circuit board (not shown).

Figure 3:
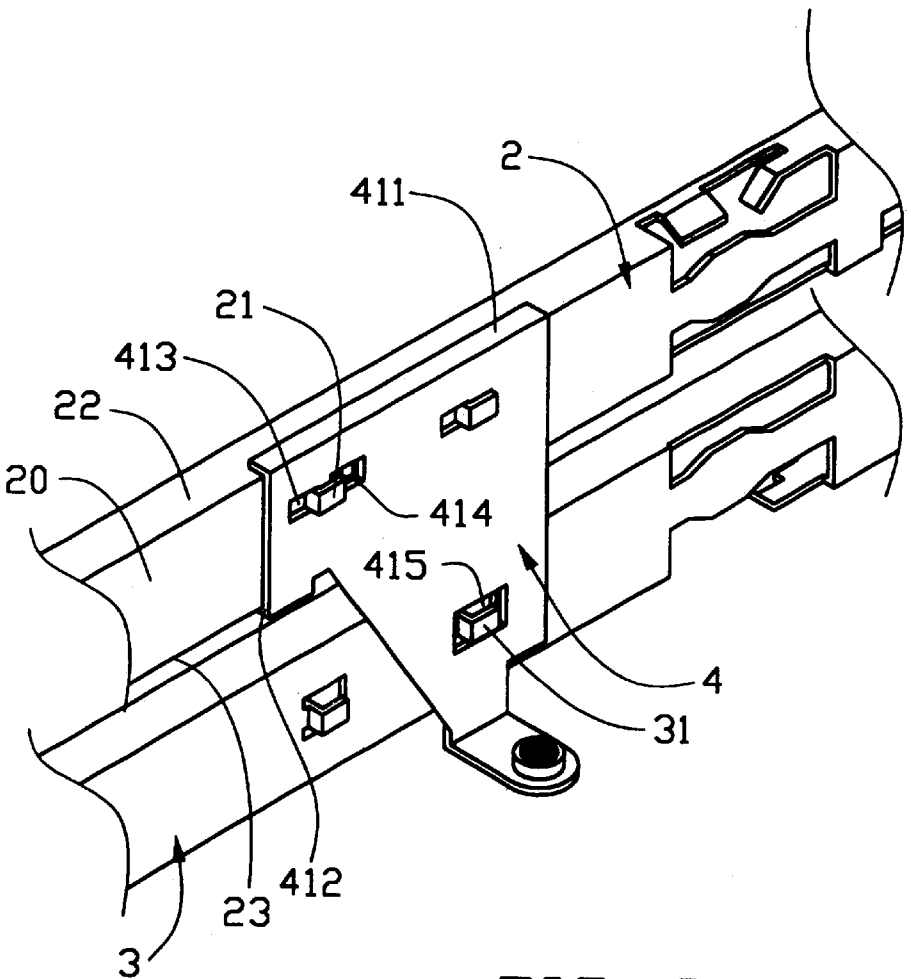
FIG. 3 is an assembled view of FIG. 2.

Referring to FIG. 3, in assembly, the latches 21 of the top shield 2 extend through the rectangular holes 413 of the stand-off 4 and engage with the base 41. The spring tab 414 of the stand-off 4 presses against the side wall 20 of the top shield 2. The lip 411 and the tab 412 of the stand-off 4 abut against the flange 22 and the shoulder 23 of the top shield 2, respectively. One latch 31 of the bottom shield 3 projects through the opening 415 of the stand-off 4. Thus, the stand-off 4 is securely attached to the top shield 2.

Figure 4:
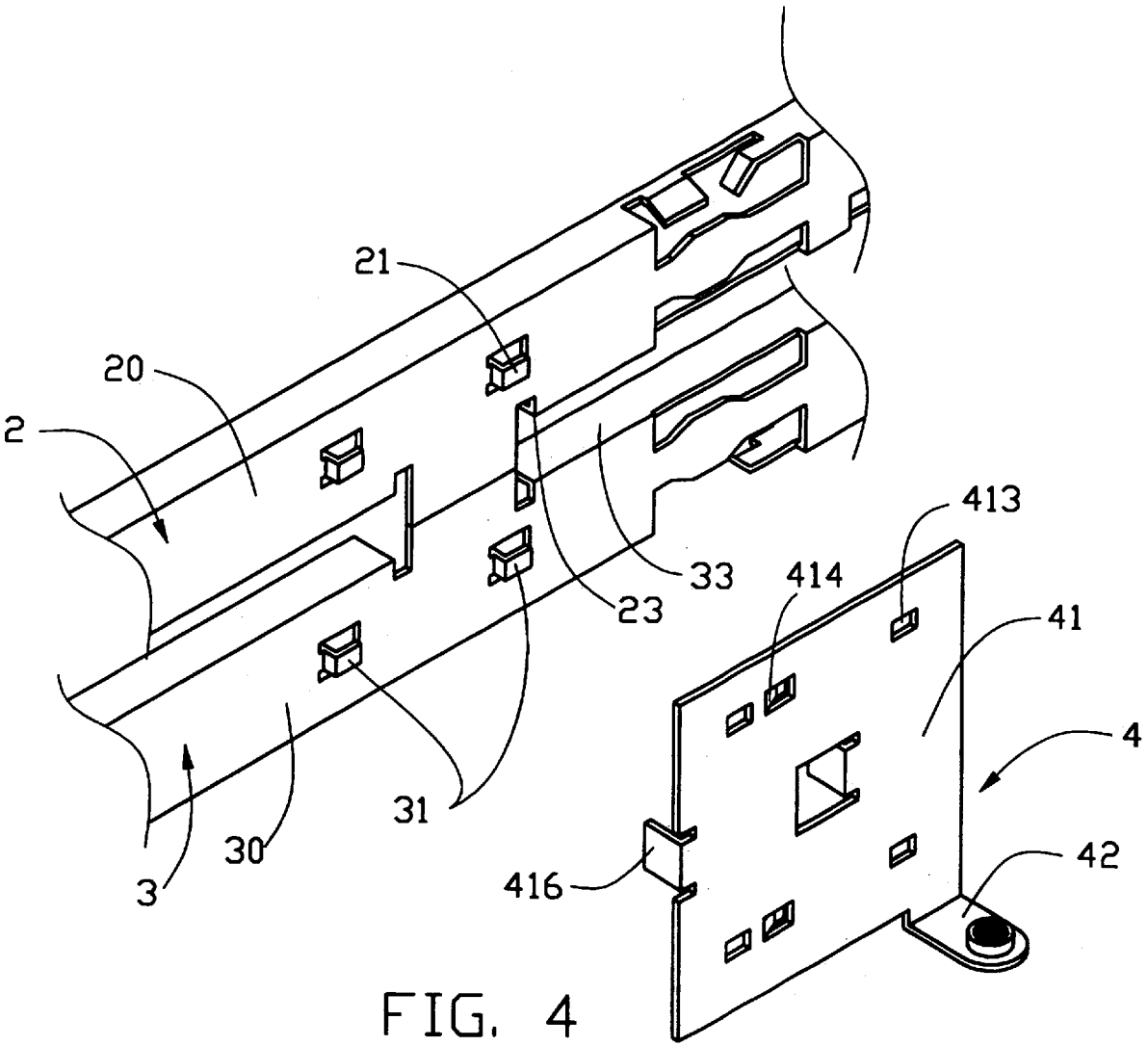
FIG. 4 is a view similar to FIG. 2 showing a second embodiment of the present invention.
Figure 5:
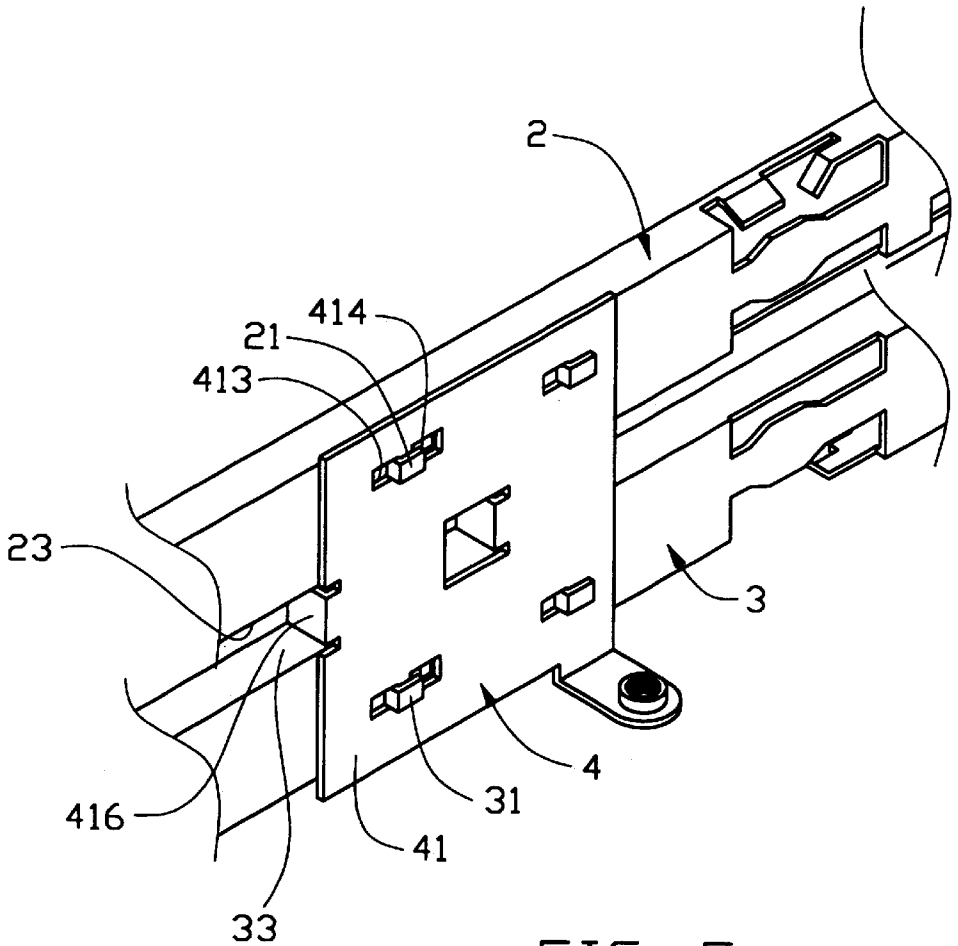
FIG. 5 is an assembled view of FIG. 4.

Referring to FIGS. 4 and 5 which show a second embodiment of the present invention, the bottom shield 3 forms a shoulder 33 extending along the longitudinal edge of the side wall 30 thereof opposite the shoulder 23 of the top shield 2. The stand-off 4 includes a base 41 and a terminal portion 42 extending from one edge of the base 41. The base 41 defines four rectangular holes 413 aligned in upper and lower rows corresponding to the latches 21, 31 of the top and bottom shields 2, 3. Each row of rectangular holes 413 defines a spring tab 414 therebetween adjacent to the rectangular hole 413 and distanced from the terminal portion 42. Two plates 416 are stamped from the base 41 between the upper and lower rows of rectangular holes 413 for being secured between the shoulders 23, 33 of the top and bottom shields 2, 3.

In assembly, the latches 21, 31 on the top and bottom shields 2, 3 extend through the upper and lower rows of rectangular holes 413 of the stand-off 4 and engage with the base 41. The spring tabs 414 press against the side walls 20, 30 of the top and bottom shields 2, 3 respectively. The plates 416 are secured between the shoulders 23, 33 of the top and bottom shields 2, 3. Thus, the stand-off 4 is securely attached to the top and bottom shields 2, 3.

Figure 6:
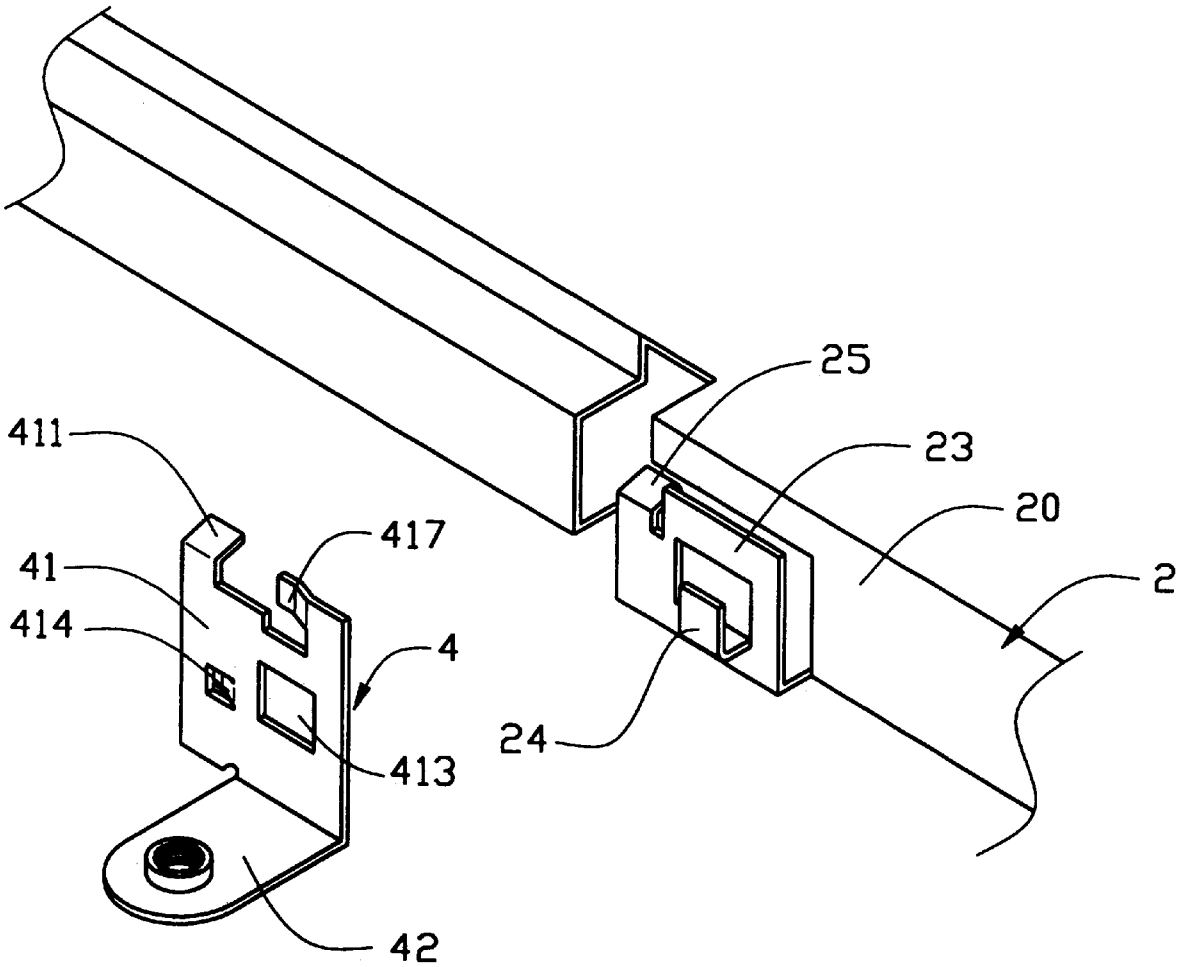
FIG. 6 is a view similar to FIG. 2 showing a third embodiment of the present invention.
Figure 7:
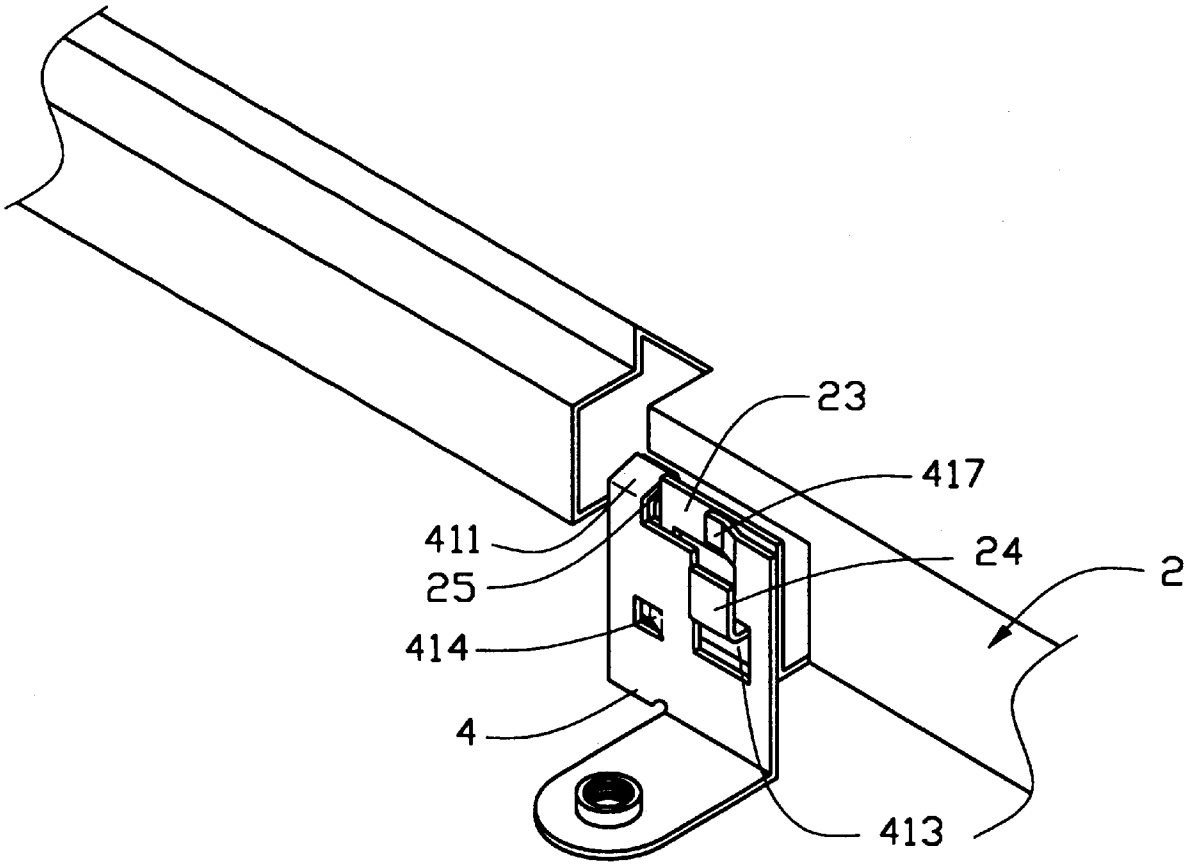
FIG. 7 is an assembled view of FIG. 6.

FIGS. 6 and 7 show a third embodiment of the present invention. The electrical card connector includes a top shield 2 and a stand-off 4 attached thereto. The top shield 2 has a right-angled board 23 projecting from the side wall 20 thereof. A clasp 24 extends from a center of the board 23 and an inclined tab 25 extends from a top portion thereof. The stand-off 4 includes a base 41 and a terminal portion 42 extending from an edge of the base 41. The base 41 forms a bent portion 411 corresponding to the inclined tab 25 of the top shield 2, a rectangular hole 413 corresponding to the clasp 24, a first spring tab 414 proximate the bent portion 411, and a second spring tab 417 proximate the rectangular hole 413.

In assembly, the bent portion 411 of the stand-off 4 abuts against the inclined tab 25 of the top shield 2, and the clasp 24 extends through the rectangular hole 413 to engage with the base 41. The first and second spring tabs 414, 417 press against the board 23. Thus, the stand-off 4 is securely attached to the top shield 2.

It is understood that the invention may be embodied in other specific forms without departing from the spirit of the central characteristics thereof. Thus, the present examples and embodiments are to be considered in all respects as illustrative and not restrictive, and the invention is not to be limited to the details given herein.

What is claimed is:

1. An electrical card connector comprising:

a main body;

a shield covering the main body and having a board projecting outward from a side wall thereof, a clasp extending from and spaced outward from a main surface of the board, the board and the side wall defining a space therebetween; and a stand-off attached to the shield and comprising a base and a terminal portion extending from the base for being mounted on a circuit board, the base forming a hole and at least one spring tab pressing against the board of the shield, the clasp extending through and engaging with the hole.

2. The electrical card connector as described in claim 1, wherein the board forms an inclined tab, and wherein the base forms a bent portion for abutting against the inclined tab.

* * * * *